US009928841B2

(12) United States Patent
Zaunschirm et al.

(10) Patent No.: US 9,928,841 B2
(45) Date of Patent: Mar. 27, 2018

(54) METHOD OF PACKET LOSS CONCEALMENT IN ADPCM CODEC AND ADPCM DECODER WITH PLC CIRCUIT

(71) Applicant: AKG Acoustics GmbH, Vienna (AT)

(72) Inventors: Markus Zaunschirm, Graz (AT); Paolo Castiglione, Vienna (AT)

(73) Assignee: AKG Acoustics GmbH, Vienna (AT)

( * ) Notice: Subject to any disclaimer, the term of this patent is extended or adjusted under 35 U.S.C. 154(b) by 0 days.

(21) Appl. No.: 14/949,538

(22) Filed: Nov. 23, 2015

(65) Prior Publication Data

US 2016/0148619 A1 May 26, 2016

(30) Foreign Application Priority Data

Nov. 21, 2014 (EP) ..... 14194269

(51) Int. Cl.
*G10L 19/00* (2013.01)
*G10L 19/005* (2013.01)
*G10L 19/032* (2013.01)

(52) U.S. Cl.
CPC ..... *G10L 19/0017* (2013.01); *G10L 19/005* (2013.01); *G10L 19/032* (2013.01)

(58) Field of Classification Search
CPC .. G10L 19/005; G10L 19/0017; G10L 19/032
(Continued)

(56) References Cited

U.S. PATENT DOCUMENTS 8,024,192 B2 9/2011 Zopf et al.
8,195,465 B2 6/2012 Zopf et al.
(Continued)

OTHER PUBLICATIONS

Kondo et al., "A Speech Packet Loss Concealment Method Using Linear Prediction", IEICE Trans. Inf. & Syst., vol. E89-D, No. 2, Feb. 2006, pp. 806-813.
Extended European Search Report for corresponding Application No. 14194269.8, dated May 29, 2015, 5 pages.
Zopf et al., "Time-Warping and Re-Phasing in Packet Loss Concealment", Interspeech 2007, Aug. 27-31, 2007, Antwerp, Belgium, pp. 1677-1680.
(Continued)

*Primary Examiner* — Jakieda Jackson
(74) *Attorney, Agent, or Firm* — Brooks Kushman P.C.

(57) ABSTRACT

A method of packet loss concealment in an adaptive differential pulse-code modulation (ADPCM) codec with a packet loss compensation (PLC) circuit is provided. The method provides a predetermined transition period between a correct signal ($x_{dec}$) and a substitute signal ($x_{PLC}$) and a difference ($d_{PLC,m}$) between the substitute signal ($x_{PLC,m}$) and a computed prediction signal ($x_{pred,m}$) is combined with a dequantized prediction error ($d_{dec,m}$) to receive a dequantized combined prediction error ($d_{comb,m}$) which is added to a predicted signal ($x_{pred,m,}$) to provide a combined transition signal ($x_{comb,m}$) as basis for an output signal ($x_{out}$–$x_{comb}$) during the predetermined transition period for adapting all decoder parameters.

17 Claims, 7 Drawing Sheets

(58) Field of Classification Search
USPC ..... 704/230
See application file for complete search history.

(56) References Cited

U.S. PATENT DOCUMENTS

| | | | | |
|---|---|---|---|---|
| 8,706,479 | B2 | 4/2014 | Zopf et al. | |
| 2007/0282601 | A1* | 12/2007 | Li | G10L 19/005 704/207 |
| 2008/0046233 | A1* | 2/2008 | Chen | G10L 19/005 704/211 |
| 2008/0046249 | A1 | 2/2008 | Thyssen et al. | |
| 2014/0163998 | A1* | 6/2014 | Cormier | G10L 19/04 704/500 |

OTHER PUBLICATIONS

Chen, "Packet Loss Concealment Based on Extrapolation of Speech Waveform", IEEE, 2009, pp. 4129-4132.
Serizawa et al., "A Packet Loss Concealment Method Using Pitch Waveform Repetition and Internal State Update on the Decoded Speech For the Sub-Band ADPCM Wideband Speech Codec", IEEE, 2002, pp. 68-70.
Thyssen et al., "A Candidate for the ITU-T G.722 Packet Loss Concealment Standard", IEEE, 2007, pp. IV-549-IV-552.
Friedlander, "Lattice Filters for Adaptive Processing", Proceedings of the IEEE, vol. 70, No. 8, Aug. 1982, pp. 829-867.
Gibson et al., "Learning Characteristics of Adaptive Lattice Filtering Algorithms", IEEE Transactions on Acoustics, Speech, and Signal Processing, vol. ASSP-28, No. 6, Dec. 1980, pp. 681-691.

* cited by examiner

METHOD OF PACKET LOSS CONCEALMENT IN ADPCM CODEC AND ADPCM DECODER WITH PLC CIRCUIT

CROSS-REFERENCE TO RELATED APPLICATIONS

This application claims priority to EP Application No. 14194269.8 filed Nov. 21, 2014, the disclosure of which is hereby incorporated in its entirety by reference herein.

TECHNICAL FIELD

One aspect of the invention relates to a method of packet loss concealment in an adaptive differential pulse-code modulation (ADPCM) codec, whereby, in the decoder, after detection of loss of a packet of encoded quantized prediction errors ($e_m$) of each subband a substitute signal ($x_{PLC}$) is created and used instead of the otherwise decoded correct signal ($x_{dec}$) for gaining an output signal ($x_{out}$) during the loss period.

BACKGROUND

Various methods of packet loss concealment are described, for example, by

- M. Serizawa and Y. Nozawa, "A Packet Loss Concealment Method using Pitch Waveform Repetition and Internal State update on the Decoded speech for the Sub-band ADPCM Wideband Speech Codec," IEEE Speech Coding Workshop, pp. 68-70, 2002.
- J Thyssen, R W Zopf, J H Chen "A Candidate for the ITU-T G.722 Packet Loss Concealment Standard", 2007, and related patents from same authors (cited in this document)
- R. W. Zopf, L. Pilati "Packet loss concealment for sub-band codecs", 2014, U.S. Pat. No. 8,706,479 B2

Such references set out to minimize degradation of audio quality at a receiver in case of lost or corrupted frames and/or packets in digital transmission of speech and audio signals. The methods range, depending on the percentage of random packet loss, from muting the signal during the loss to ramp it down or to repeat frames or pitch wave forms etc. Examples of methods for audio dropout concealment are offered in B. W. Wah, X. Su, and D. Lin: "A survey of error concealment schemes for real-time audio and video transmission over the internet". As per prior art (see R. W. Zopf, J.-H. Chen, J. Thyssen, "Updating of Decoder States After Packet Loss Concealment"), the ADPCM decoder parameters are adapted independently to the encoded prediction error ($e_m$) of each subband during a dropout, since it is partially or totally corrupted. In prior art, original and substitute signal are cross-faded (overlap-add method) in the uncompressed audio domain at the edges of the transmission dropout. During the fading, the prior art adopts technique such "time-warping" of the audio signals and "re-phasing" of the predictor registers (see ITU-T G.722 Appendix III packet loss concealment standard; R. Zopf, J. Thyssen, and J.-H. Chen. "Time-warping and re-phasing in packet loss concealment." INTERSPEECH 2007; and J.-H. Chen, "Packet loss concealment based on extrapolation of speech waveform.", *ICASSP IEEE International Conference on Acoustics, Speech and Signal Processing* IEEE, 2009) in order to re-align the phases of $x_{dec}$ and $x_{PLC}$. The latter two techniques require, however, a significant amount of delay in order to compute the "time lag" that is hardly acceptable for professional wireless microphones where the total latency (audio analog input to audio analog output) is about 3 milliseconds.

SUMMARY

In one object, it is possible to conceal the abrupt transients between a correct signal ($X_{dec}$) and an extrapolated substitute signal ($x_{PLC}$) in wireless transmission of ADPCM encoded audio data between professional wireless microphones and receivers in order to minimize the error audibility and its propagation over the time.

This object is obtained with a method, in that in a predetermined transition period between the correct signal ($x_{dec}$) and the substitute signal ($x_{PLC}$), the difference ($d_{PLC,m}$) between the substitute signal ($x_{PLC,m}$) and the computed prediction signal ($x_{pred,m}$) in each subband is combined with the dequantized prediction error ($d_{dec,m}$) to receive a dequantized combined prediction error ($d_{comb,m}$) which is added to the predicted signal ($x_{pred,m}$) to gain a combined transition signal ($x_{comb,m}$) as basis for an output signal ($x_{out}-x_{comb}$) during the transition period as well as for adapting all decoder parameters.

One aspect of the method lies in the combination of the ADPCM prediction error, obtained from the reconstructed data in a previously undisclosed form, with the original ADPCM prediction error signal ($d_{dec,m}$). This method is proposed for decoding the ADPCM signals where both the correctly received ADPCM signal ($x_{dec}$) and an extrapolated substitute audio signal ($x_{PLC}$) are available, before and after a transmission dropout.

ADPCM with larger memory (prediction filters with number of poles >5) exhibits on one hand better encoding performance, on the other hand, the ADPCM with the large memory is more prone to transmission errors (in the literature this problem is typically referred to as mistracking) The detrimental effects can last for a long time after the dropout (error propagation), even if the dropout is of small duration. The disclosed embodiment makes it possible to conceal the abrupt transients between correct audio and extrapolated audio when a transmission dropout occurs. It does not imply additional latency. Furthermore, it allows indirectly to adopt high quality ADPCM codecs with large memory of the pole predictor, as this method makes it more resilient to transmission errors. This method is therefore suitable for a professional wireless microphone application, where large prediction gains allow better sound qualities to be achieved.

In an embodiment, the weighted combined sum ($d_{comb,m}$) of the dequantized prediction error ($d_{dec,m}$) of the correct signal ($x_{dec,m}$) and the prediction error ($d_{PLC,m}$) of the substitute signal ($x_{PLC,m}$) is received by:

$$d_{comb,m}=(1-w_m)\times d_{dec,m}+w_m\times d_{PLC,m},$$

wherein the weighting function $w_m$ is increasing over the time from 0 to 1 during the transition from the correct signal ($x_{dec}$) to the substitute signal ($x_{PLC}$) and decreasing from 1 to 0 during the transition from the substitute signal ($x_{PLC}$) to the correct signal ($x_{dec}$).

The combination function can be made more simple and abrupt for the high pass subbands to save complexity where it is less audible. Other possible combining functions can, for example, be made dependent on the status of the prediction filter.

The disclosed method allows the prediction filter to efficiently adapt to $x_{PLC}$ from $x_{dec}$, and, vice versa, to mildly recover the correctly decoded signal $x_{dec}$ from $x_{PLC}$. The quantization is adapted by using the original received prediction error signal $e_m$, although the method can be extended to the adaptation of the quantizer based on the combined prediction error $d_{comb,m}$.

The disclosed method relates also to an ADPCM decoder with a packet loss concealment (PLC) circuit for performing the forgoing described method. The decoder is includes an error combiner circuit having two inputs, one is connected to the output of the PLC circuit and one to the input of the ADPCM decoder, as well as two outputs, one for its output signal ($x_{comb}$) and one for adapting the ADPCM decoder.

In an embodiment, the error combiner circuit comprises at one input an analysis filterbank for downsampling of the substitute signal ($x_{PLC}$), received from the PLC circuit, into subband signals ($x_{PLC,m}$) and at another input, an adaptive dequantization unit for the encoded, quantized, downsampled prediction error ($e_m$) received from the input of the ADPCM decoder. An adaptive prediction unit is connected with one of two outputs to a subtractor, receiving the subband substitute signal ($x_{PLC,m}$) from the analysis filterbank, and with the other output to an adder. A concealment prediction error shaper, connected to the output of the adaptive dequantization unit, is positioned between the subtractor and the adder and the output of the adder has a feedback loop to the adaptive prediction unit and leads to a synthesis filterbank for recombining the resulting combined subband substitute signals ($x_{comb,m}$) to gain an output signal ($x_{out}$–$x_{comb}$). The concealment prediction error shaper produces, in a predetermined manner, a weighted sum of the dequantized prediction error ($d_{dec,m}$) and the prediction error ($d_{PLC,m}$) of the subband substitute signal ($x_{PLC,m}$).

BRIEF DESCRIPTION OF THE DRAWINGS

The embodiments are explained in more detail in connection with the drawings.

DETAILED DESCRIPTION

Figure 1:
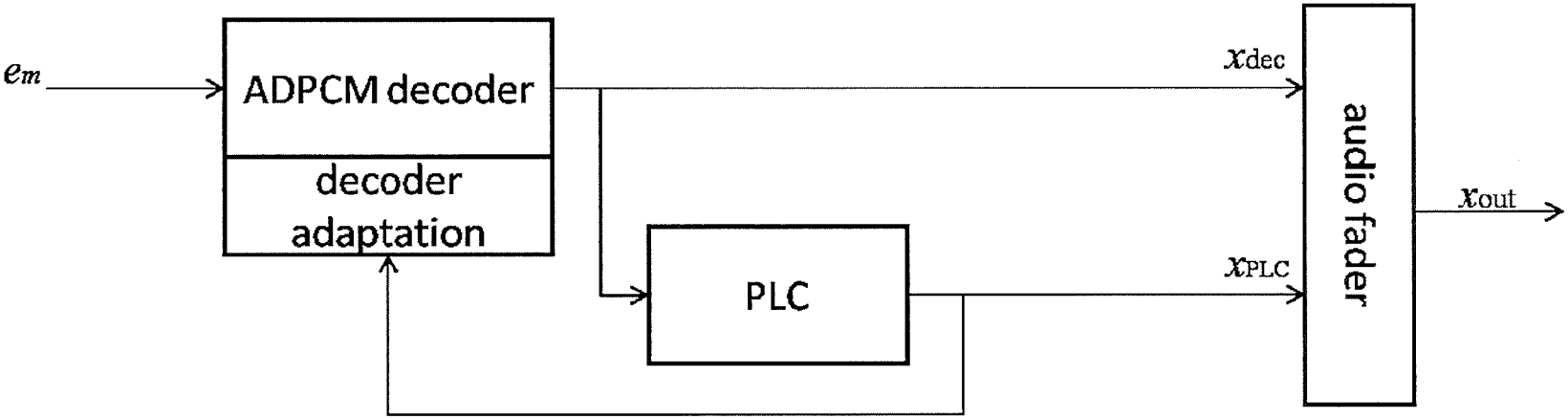
FIG. 1 shows a scheme of a packet loss concealment (PLC) according to the state of art.

In ADPCM encoded audio transmission, the prediction error $e=\{e_1, e_2, \ldots, e_m, \ldots, e_{M-1}, e_M\}$ of all M subbands is communicated to the receiver and used to decode the original audio signal as well as to adapt the ADPCM decoder parameters such as the prediction coefficients. As shown I FIG. 1, the predictor filter registers and the (inverse) quantization function, as depicted in FIG. 1. If e is received incorrectly, i.e., a dropout is detected by means of a proper checksum, typically the audio output $x_{out}$ of the ADPCM decoder is replaced by an extrapolated substitute signal $x_{PLC}$ provided by a packet loss concealment (PLC).

Figure 2:
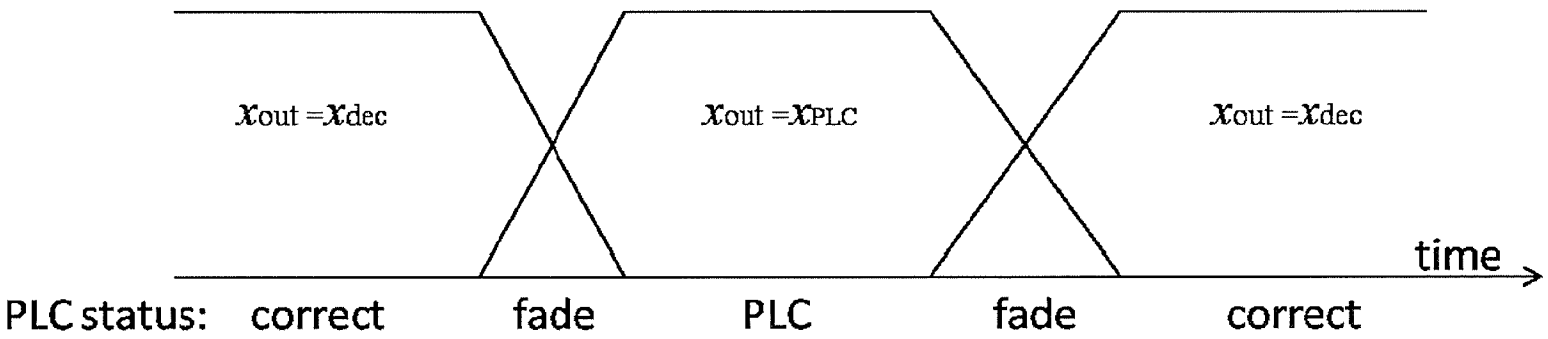
FIG. 2 shows a time line of the concealment method according to FIG. 1.
Figure 3:
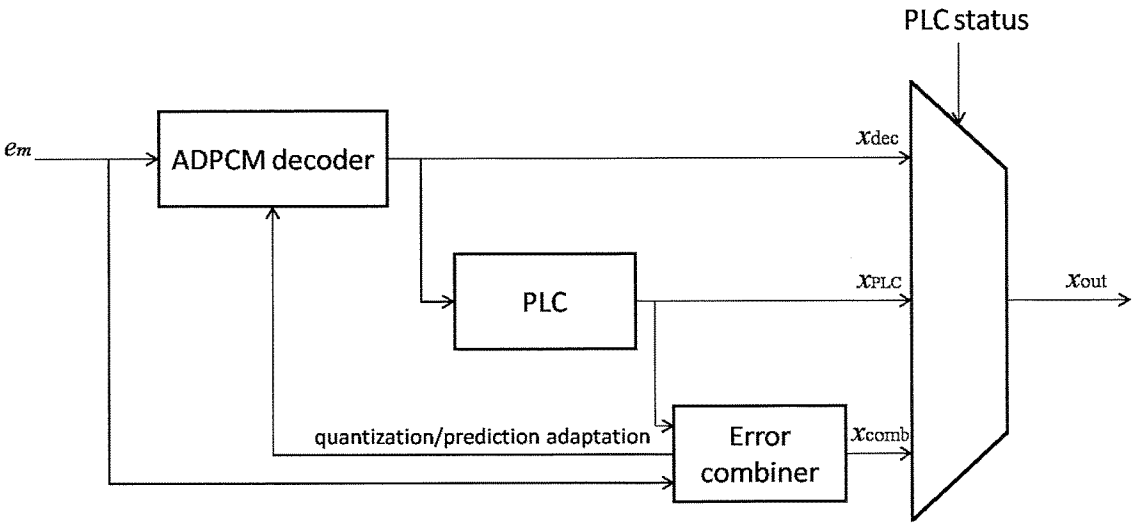
FIG. 3 shows a PLC-scheme in accordance with the features disclosed herein (i.e., a block diagram of the new ADPCM decoder equipped according to an embodiment of the invention)
Figure 4:
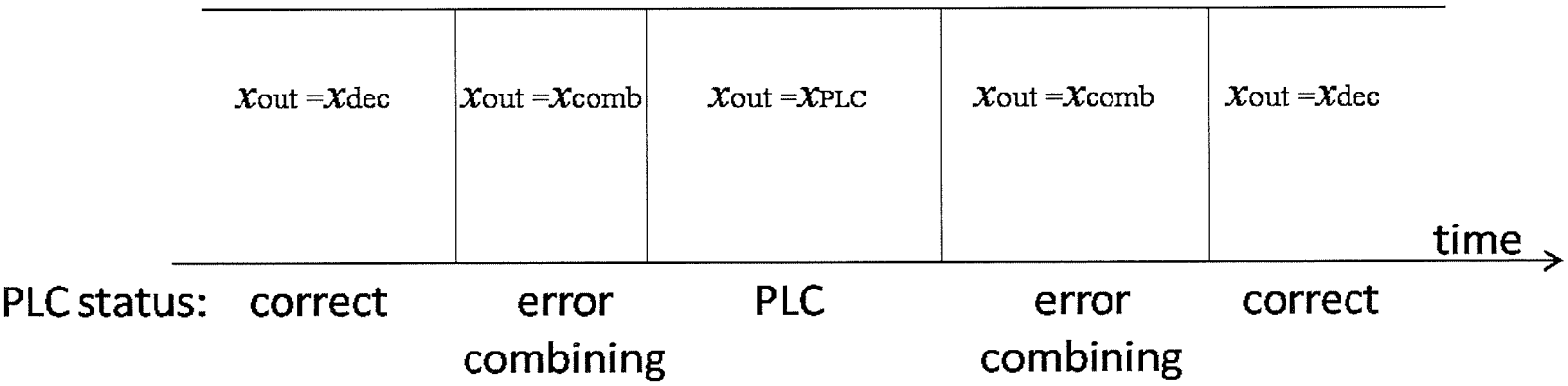
FIG. 4 shows a time line in accordance to the method of packet loss concealment.

As can be gathered from the time line of FIG. 2, the transition between the correct and substitute signal (and vice versa) is so far cross-faded in the uncompressed audio domain in order to subpress its audibility. However, even that method does not avoid a more or less audible transient between the correct signal $x_{dec}$ and the substitute signal $x_{PLC}$. Moreover, signal artifacts can occur due to ADPCM mistracking in the transition from substitute signal to correct signal, and this negative effect can last too long for professional wireless microphones. To solve these problems, aspects disclosed herein provide an "error combiner" (see FIG. 3) which is activated in the transition period between the correct signal $x_{dec}$ and the substitute signal $x_{PLC}$ (and vice versa) and which performs the method of the packet loss concealment. The error combiner has two inputs, one is connected to the output of the PLC circuit and one to the input of the ADPCM decoder, as well as two outputs, one for its output signal ($x_{comb}$) and one or adapting the ADPCM decoder. It finally creates a combined substitute signal $x_{comb}$ which is effective in the transition period as shown in FIG. 4. The combined substitute signal $x_{comb}$ can be time-multiplexed between the original decoded signal $x_{dec}$ and the extrapolated substitute signal $x_{PLC}$ obtained by the dropout concealment at hand. One output of the error combiner is also used for adapting the parameters of the ADPCM decoder. As can be gathered from FIGS. 3 and 4, there are three options for gaining a final output signal $x_{out}$:

1. Without any packet loss the correct signal $x_{dec}$ equals the output signal $x_{out}$;
2. at the beginning and ending of the activity of the packet loss concealment the output signal $x_{out}$ is defined by the combined substitute signal $x_{comb}$; and
3. during the PLC outside the transition period the substitute signal $x_{PLC}$ is that one that represents the output signal $x_{out}$.

Figure 5:
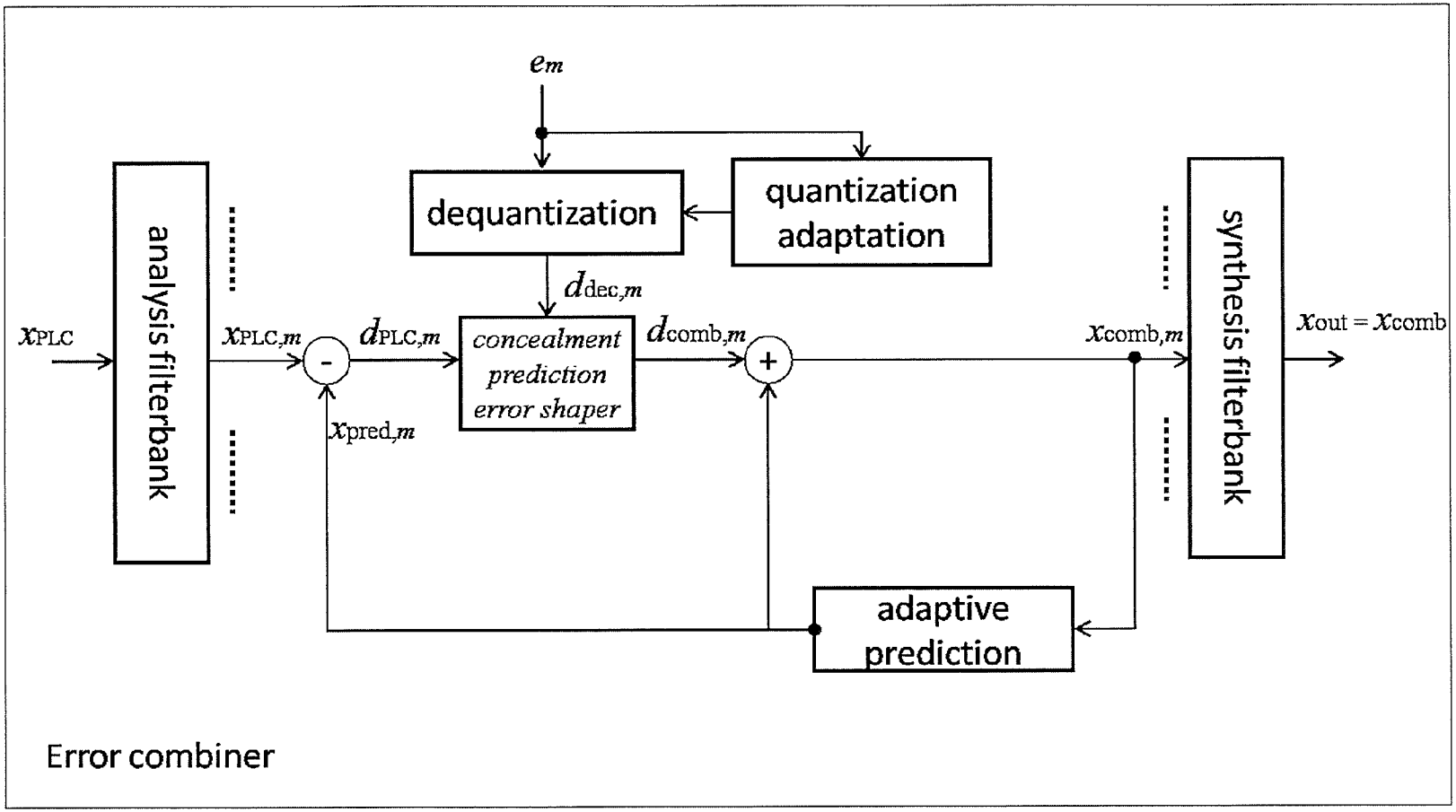
FIG. 5 shows a block-diagram of a circuit for performing the method of packet loss concealment (i.e., a block diagram of the featured error combiner)

FIG. 5 reflects the error combiner (FIG. 4) which comprises at one input, an analysis filterbank for downsampling of the substitute signal ($x_{PLC}$), received from the PLC circuit, into subband signals ($x_{PLC,m}$) and at the other input an adaptive dequantization unit for the encoded, quantized, downsampled prediction error ($e_m$) received from the input of the ADPCM decoder. An adaptive prediction unit is connected with one of two outputs to a subtractor, receiving the subband substitute signal ($x_{PLC,m}$) from the analysis filterbank, and with the other output to an adder. A concealment prediction error shaper, connected to the output of the adaptive dequantization unit, is positioned between the subtractor and the adder. The output of the adder has a feedback loop to the adaptive prediction unit and leads to a synthesis filterbank for recombining the resulting combined subband substitute signals ($x_{comb,m}$) to gain an output signal ($x_{out}$=$x_{comb}$). The concealment prediction error shaper produces, in a predetermined manner, a weighted sum of the dequantized prediction error ($d_{dec,m}$) and the prediction error ($d_{PLC,m}$) of the subband substitute signal ($x_{PLC,m}$).

In the error combiner, the method of packet concealment is performed, in that the substitute signal $x_{PLC}$ created by the PLC (FIG. 3) is used in combination with the original prediction error $e_m$, sent by the ADPCM encoder (not shown), for adapting the decoder parameters and for generating the decoder output during the transients between the correct received signal $x_{dec}$ and the substitute signal $x_{PLC}$, and vice versa.

The substitute signal $x_{PLC}$ is fed to an ADPCM analysis filter-bank. Hence, the downsampled signals $X_{PLC,1}$, $x_{PLC,2}, \ldots, x_{PLC,m}, \ldots, x_{PLC,M-1}, x_{PLC,M}$ corresponding to each of the M subbands, are obtained. To each downsampled substitute signal $x_{PLC,m}$ the computed ADPCM predicted signal $X_{pred,m}$ is subtracted, yielding the concealment or substitute prediction error $d_{PLC,m}-X_{PLC,m},-x_{pred,m}$. The substitute prediction error $d_{PLC,m}$ is then summed to the true received dequantized prediction error signal $d_{dec,m}=Q^{-1}(e_m)$ according to a time-varying function $f_m(d_{dec,m},d_{PLC,m})$ that also depends on the drop out status. The combined prediction error $d_{comb,m}$ is then summed to the prediction output $x_{pred,m}$ to produce the decoder output $x_{comb}$, which is then used for updating the prediction filter registers as well as the prediction coefficients.

The combined prediction error $d_{comb,m}$ can vary between $d_{dec,m}$ (when the error combiner becomes the general ADPCM decoder) and $d_{PLC,m}$ (when the error combiner becomes the PLC). Hence, a good candidate for the combination function $f_m(d_{dec,m},d_{PLC,m})$ is the time-varying weighting function $W_m$ as $$d_{comb,m}=(1-w_m)\times d_{dec,m}+w_m\times d_{PLC,m},$$

where function $w_m$ is increasing over time from 0 to 1 during the transition from $x_{dec}$ to $x_{PLC}$, as opposed to the transition from $x_{PLC}$ to $x_{dec}$ where it is decreasing from 1 to 0.

The technical progress and advantage of the method of packet loss concealment is shown by the following example in which it is compared with the conventional method of fading from the substitute signal to the original signal. The ADPCM codec utilizes a predictor with eight poles that are updated according to a gradient adaptive lattice (GAL) algorithm (see Benjamin Friedlander, "Lattice filters for adaptive processing," Proceedings of the IEEE, vol. 70, no. 8, pp. 829-867, August 1982. and C. Gibson and S. Haykin, "Learning characteristics of adaptive lattice filtering algorithms," Acoustics, Speech and Signal Processing, IEEE Transactions on, vol. 28, no. 6, pp. 681-691, December 1980.). For fair comparison, both methods under test conveniently adopt the most recent re-encoding techniques for the update of the prediction coefficients as well as for the update of the quantizer during the packet loss concealment (see M. Serizawa and Y. Nozawa, "A Packet Loss Concealment Method Using Pitch Waveform Repetition and Internal State Update on the Decoded Speech for the Sub-Band ADPCM Wideband Speech Codec," Proc. ICASSP, pp. 68-71, May 2002 and J. Thyssen, R. Zopf, J.-H. Chen and N. Shetty, "A Candidate for the ITU-T G.722 Packet Loss Concealment Standard," Proc. IEEE Int'l Conf. Acoustics, Speech, and Signal Processing, vol. 4, pp. IV-549-IV-552, April 2007.).

For the conventional method, a fader is implemented by performing an overlap-add between segments of the two audio signals properly weighted for 160 samples after the end of the dropout (see prior art and also the most recent relevant patents where the same technique is suggested, see U.S. Pat. No. 8,706,479 B2, R. W. Zopf, L. Pilati "Packet loss concealment for sub-band codecs", 2014).

For the method of packet loss concealment, an error combination according to a time-varying weighting function a function $f_m(d_{calc,m},d_{sub,m})=(1-w_m)\times d_{calc,m}+w_m\times d_{sub,m}$ is applied. The error combiner is also used for 160 samples after the end of the dropout.

Figure 6:
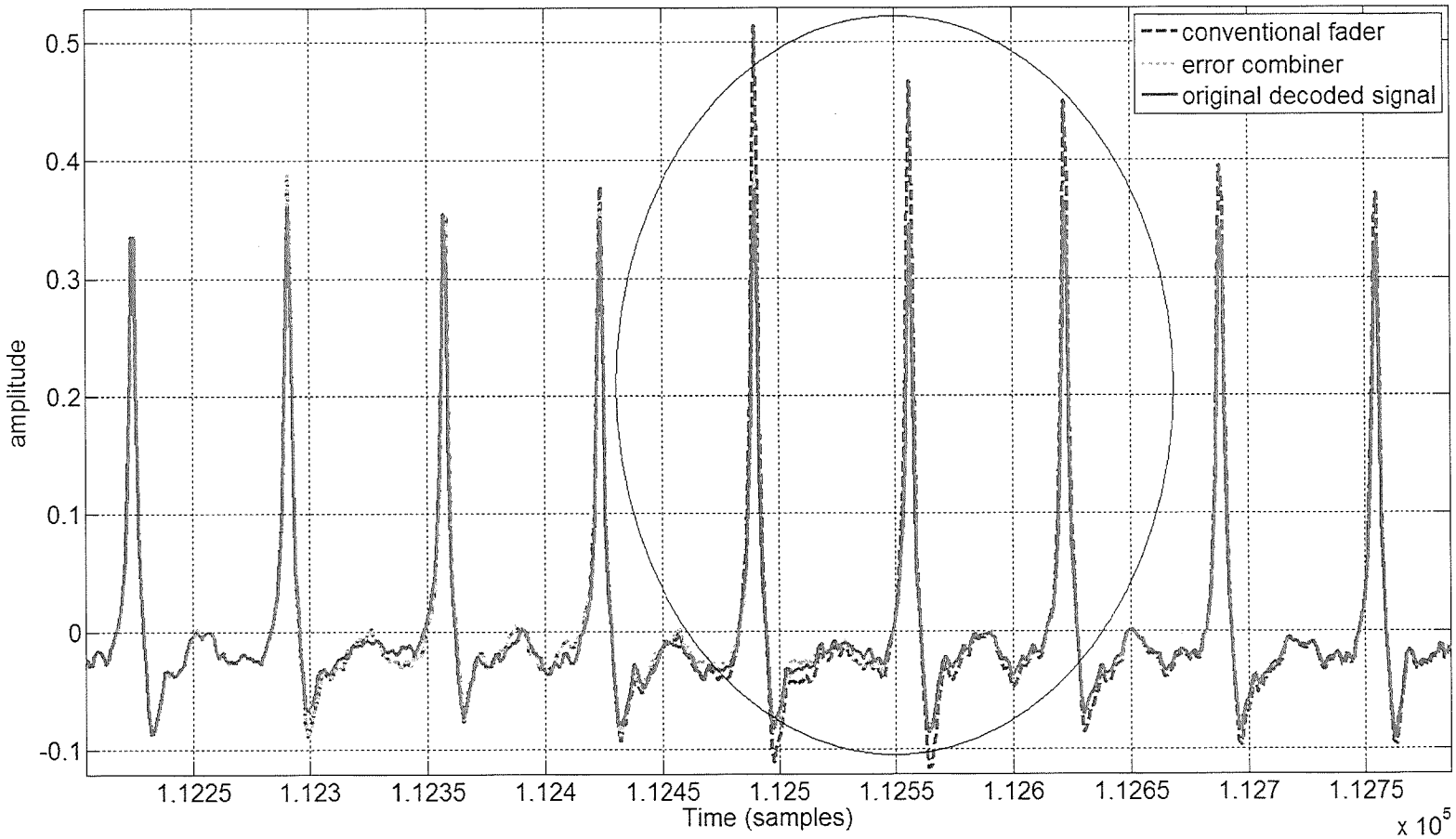
FIG. 6 is a diagram of a trumpet signal with PLC in accordance to one embodiment when compared to a conventional implementation.

The example refers to a decoded trumpet signal shown in FIG. 6. The dropout starts at sample $1.123\times10^5$ and finishes at $1.124\times10^5$ (the sampling frequency is 44.1 kHz). FIG. 6 shows clearly that, despite the PLC signal is matching very well the original signal, the transition to the original signal takes more time for the conventional fader when compared to the presented error combiner in this example.

State-of-art re-encoding techniques do not always update the decoder registers and the GAL coefficients in a way that the original signal can be decoded well enough right after the dropout. This has also been disclosed in related literature (R. W. Zopf, J.-H. Chen, J. Thyssen, "Updating of Decoder States After Packet Loss Concealment"), where the authors have proposed to change the values of the parameters that govern the update of the predictor and of the quantizer during the transition to good audio. Note that the excellent performance of the disclosed embodiment is achieved without the need of imposing such ad-hoc changes. The fader also mitigates this problem, but not efficiently enough, as for the trumpet signal in this example (that is very unfriendly to ADPCM due to the extreme crest-factor). Note that time-warping and re-phasing techniques (see U.S. Pat. No. 8,195,465 B2, R. W. Zopf, J.-H. Chen, J. Thyssen "Time-warping of decoded audio signal after packet loss", 2012 and related patents of the same authors) are not applied. The latter two techniques are anyway not helpful in this example, as the phase of the substitute signal is the same as the correct signal.

Figure 7:
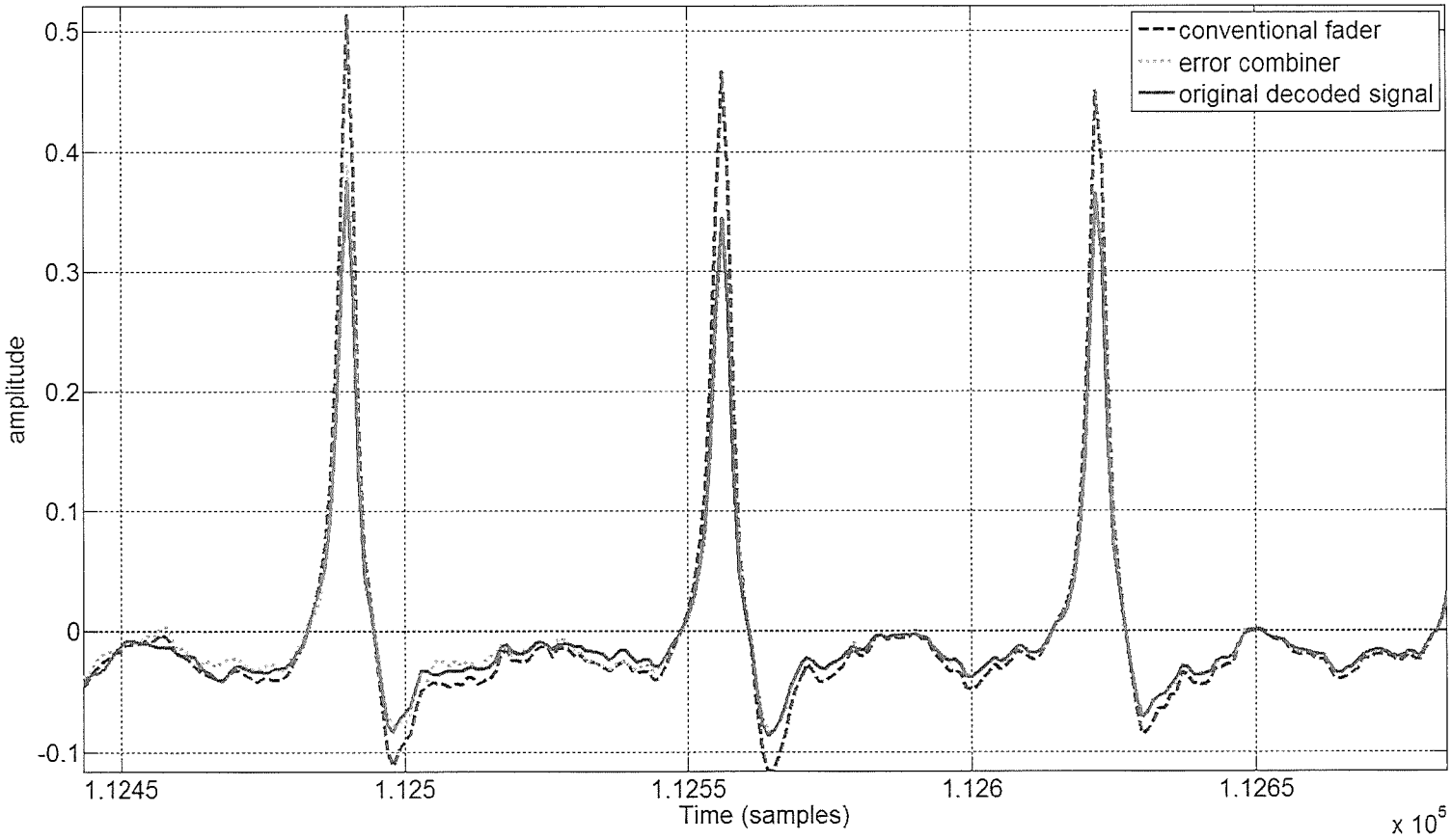
FIG. 7 illustrates an encircled portion of the signal of FIG. 6 in an enlarged version.

FIG. 7 is an enlarged version of the detail encircled portion in FIG. 6. It highlights the transition from PLC to the original signal for time duration of 4 ms after the packet loss. The output of the error combiner (dotted line) matches very well the uncorrupted decoded signal (original signal, solid line), whereas the conventional fader (dashed line) is not able to quickly recover the original signal. In other words, the error combiner is able to rapidly resolve the prediction mis-tracking problem due to its feedback structure. On the other hand, such mis-tracking effect is recognizable for the conventional fader at the signal peaks. Although a single occurrence of such effect is practically inaudible, a periodic packet loss pattern, generated for instance by a bursty radio interferer (e.g., by a TDMA wideband system), is strongly detrimental for the audio quality. This type of interference is likely to be experienced nowadays by wireless microphones receivers due to the coexistence in the same spectrum of wideband "white space devices" [cite: Report 204 of the Electronic Communications Committee (ECC) within the European Conference of Postal and Telecommunications Administrations (CEPT), available at http://www.erodocdb.dk/Docs/doc98/official/pdf/ECCREP204.PDF, and Report 159, available at http://www.erodocdb.dk/Docs/doc98/official/pdf/ECCREP159.PDF] and due to the spurious emissions of 4G cellular mobile transmitters [cite: Report 221, available at http://www.erodocdb.dk/Docs/doc98/official/Word/ECCREP221.PDF]. For such type of interference, the better performance of the error combiner are particularly beneficial.

The relevant characteristics of the method of packet loss concealment is performed in the error combiner are summarized as follows:

- the transitions between original and extrapolated substitute signal occur in the ADPCM prediction error domain, such that the combined prediction error signal is used for the adaptation of the prediction coefficients according to the method of packet loss concealment at hand;
- the error combination is done in a subband-specific fashion, such that complexity can be saved by performing more complex error combinations only in the lowest subbands where signal imperfections are more audible. However, the method can be used also in conjunction to a wideband ADPCM with only one subband (m=1);

the method does not add any latency to the latency of the ADPCM and of the dropout concealment technique at hand;

as per performance assessment (see above), the method of packet loss concealment works very efficiently also for music signals that are very challenging for ADPCM; and for the two above reasons, the invented method is a suitable candidate for professional wireless microphones, where latency and audio quality for music signals play a more important role compared to voice-over-IP and speech-only applications in general.

What is claimed is:

1. A method of packet loss concealment in an adaptive differential pulse-code modulation (ADPCM) codec comprising: after detection of loss of a packet of encoded quantized prediction errors for each subband, a substitute signal is generated by a packet loss concealment (PLC) circuit of an error combiner in a decoder and used instead of a decoded correct signal for generating an output signal during a loss period, wherein, that in a predetermined transition period between the decoded correct signal and the substitute signal, a difference between the substitute signal and a computed prediction signal in each subband is combined with a dequantized prediction error to output a dequantized combined prediction error to an adder of the error combiner to add the computed predicted signal to the dequantized combined prediction error to output a combined transition signal as basis for an output signal during the predetermined transition period in addition to adapting all decoder parameters, wherein the dequantized combined prediction error is based on a weighting function that increases over time from a first value to a second value during a transition from the decoded correct signal to the substitute signal and decreases from the second value to the first value during the transition from the decoded substitute signal to the decoded correct signal.

2. A wireless microphone that includes the method of claim 1.

3. A method of packet loss concealment in an adaptive differential pulse-code modulation (ADPCM) codec, the method comprising:

detecting a loss of a packet of encoded quantized prediction errors for each subband;

generating a substitute signal via a packet loss concealment (PLC) circuit after detecting the loss of the packet of encoded quantized prediction errors;

utilizing the substitute signal to provide an output signal during a loss period;

generating a difference signal between the substitute signal and a computed prediction signal in each subband with a dequantized prediction error to output a dequantized combined prediction error to an adder of an error combiner;

adding the dequantized combined prediction error to the computed predicted signal, via the adder, to provide a combined transition signal as a basis for an output signal during a predetermined transition period, wherein the predetermined transition period is between a decoded correct signal and the substitute signal; and increasing a weighting function of a dequantized combined prediction error from a first value to a second value during the predetermined transition period from the decoded correct signal to the substitute signal.

4. The method of claim 3 further comprising decreasing from the second value to the first value during the predetermined transition period from the substitute signal to the decoded correct signal.

5. The method of claim 4 wherein the first value is 0 and the second value is 1.

6. An ADPCM decoder and a packet loss concealment (PLC) circuit configured to perform the method of claim 3, comprising an error combiner circuit including a first input connected to an output of the PLC circuit and a second input connected to an input of the ADPCM decoder, wherein the error combiner circuit further including a first output to provide the output signal and a second output for adapting the ADPCM decoder.

7. The ADPCM decoder and the PLC circuit according to claim 6 wherein the error combiner circuit includes:

an analysis filterbank to downsample the substitute signal received from the PLC circuit into subband substitute signals; and an adaptive dequantization unit to receive the prediction errors from the ADPCM decoder.

8. The ADPCM decoder and the PLC circuit according to claim 7 further comprising:

an adaptive prediction unit;

a subtractor that receives the subband substitute signals from the analysis filterbank, and an adder coupled to the adaptive prediction unit.

9. The ADPCM decoder and the PLC circuit according to claim 8 further comprising a concealment predictor error shaper to form a feedback loop with the adaptive prediction unit to provide the subband substitute signals.

10. The ADPCM decoder and the PLC circuit according to claim 9 further comprising a synthesis filter bank to receive the subband substitute signals and to generate an output signal.

11. The ADPCM decoder and the PLC circuit according to claim 10 wherein the concealment predictor error shaper produces, in a predetermined manner, a weighted sum of the dequantized prediction error and a prediction error of the subband substitute signals.

12. An apparatus of packet loss concealment in an adaptive differential pulse-code modulation (ADPCM) codec, the apparatus comprising:

a decoder to detect a loss of a packet of encoded quantized prediction errors for a number of subbands;

a packet loss concealment (PLC) circuit to generate a substitute signal in response to the decoder detecting the loss of the packet of encoded quantized prediction errors;

an error combiner circuit to:

receive the substitute signal to generate an output signal during a loss period;

combine a difference signal between the substitute signal and a computed prediction signal in each subband with a dequantized prediction error to receive a dequantized combined prediction error; and add the dequantized combined prediction error to the computed predicted signal to provide a combined transition signal as a basis for an output signal during a predetermined transition period, wherein the predetermined transition period is between a decoded correct signal and the substitute signal; and wherein a weighting function of a dequantized combined prediction error is increased from a first value to a second value during the predetermined transition period from the decoded correct signal to the substitute signal.

13. The apparatus of claim 12 wherein the error combiner circuit includes:

an analysis filterbank to downsample the substitute signal into subband substitute signals; and an adaptive dequantization unit to receive the encoded quantized prediction errors.

14. The apparatus of claim 13 where the error combiner circuit further includes:

an adaptive prediction unit;

a subtractor that receives the subband substitute signals from the analysis filterbank, and an adder coupled with the adaptive prediction unit.

15. The apparatus of claim 14 wherein the error combiner circuit further includes a concealment predictor error shaper to form a feedback loop with the adaptive prediction unit to provide the subband substitute signals.

16. The apparatus of claim 15 wherein the error combiner circuit includes a synthesis filter bank to receive the subband substitute signals and to generate an output signal.

17. The apparatus of claim 16 wherein the concealment predictor error shaper produces, in a predetermined manner, a weighted sum of the dequantized prediction error and a prediction error of the subband substitute signals.

* * * * *